US005287614A

United States Patent [19]

Ehrlich

[11] Patent Number: 5,287,614

[45] Date of Patent: Feb. 22, 1994

[54] TABLE SKIRT-ATTACHING METHOD AND ATTACHING CLIP

[76] Inventor: Paul Ehrlich, 241 Mill St., Lawrence, N.Y. 11559

[21] Appl. No.: 29,174

[22] Filed: Mar. 10, 1993

[51] Int. Cl.[5] ..... B32B 3/06

[52] U.S. Cl. ..... 29/450; 29/525.1; 150/158; 428/99; 428/100

[58] Field of Search ..... 428/99, 100; 150/158; 29/450, 525.1

[56] References Cited

U.S. PATENT DOCUMENTS 1,981,740 11/1934 Mix ..... 24/49 P 3,453,696 7/1989 Mates ..... 24/306

4,708,183 11/1987 Figueroa ..... 24/306

*Primary Examiner*—Alexander S. Thomas

[57] ABSTRACT

A method of attaching a decorative skirt about a banquet tablecloth using spring clips with Velcro patches in which initially the spring clips in spaced apart relation are engaged to extend radially from the tablecloth but are then pivoted, as allowed by the flexibility of the cloth, into a vertical plane in which the Velcro patches thereon face outwardly of the table and are readily attached to a cooperating Velcro strip on the decorative skirt.

1 Claim, 1 Drawing Sheet

TABLE SKIRT-ATTACHING METHOD AND ATTACHING CLIP

The present invention relates generally to applying a decorative skirt to a banquet or similar table to mask the legs thereof as well as enhance its appearance with the color, pleats or other features of the attached skirt, and more particularly to improvements in the use of table-attaching Velcro-embodied clips, having novelty in and of themselves, as will be subsequently disclosed herein, in achieving the suspension of the skirt about the peripheral edge of the table.

EXAMPLE OF THE PRIOR ART

It is already well known, as exemplified by U.S. Pat. No. 4,708,183 issued on Nov. 24, 1987 to Figueroa, that interengaging Velcro patches and strips are an effective means of removably attaching a decorative skirt to a table. In Figueroa, plastic clips with Velcro patches are strategically located about the table edge and a Velcro strip sewn or otherwise secured along the top of the decorative skirt is engaged to the patches on the previously positioned clips to complete the application of the skirt to the table.

The prior art above noted clips do not always remain attached to the table edge after the skirt is removed for cleaning or the like, and thus often are misplaced. And, if applied with sufficient gripping pressure to avoid shifting in position and to remain attached to the table, the clips might mar the surface of the table. An even more significant shortcoming is the unavoidable difficulty in achieving an attachment for each prior art clip since the attachment is to the edge of the table. In sharp contrast, and underlying the present invention, is the recognition that the attachment is greatly and significantly facilitated if made, not to the table but to the tablecloth while in its covering relation over the table, all as will be subsequently explained in detail.

Generally, it is an object of the present invention to provide a table skirt-attaching method overcoming the foregoing and other shortcomings of the prior art. Specifically, it is an object to use Velcro in attaching the skirt to the tablecloth, but to apply the Velcro to a spring clip and to attach these Velcro-embodied clips to the tablecloth, which is readily achieved, rather than attempting an attachment to the edge of the table. Initially the clips extend radially of the table, with the Velcro patches thereon in a horizontal orientation, but as readily permitted by the flexibility of the fabric construction material of the table covering, the attached clips are urged through a 90 degree pivotal traverse which strategically locates the Velcro patches thereon in a vertical orientation and, more importantly, in an outwardly facing relation from the table. The skirt, embodied with a cooperating Velcro strip, is readily connected to the Velcro patches on the spacedapart clips, thus completing the attachment of the skirt about the periphery of the table.

As used above and in the description which follows, the reference to Velcro, a registered trademark of the Velcro Manufacturing Co., will be understood to be a hook and loop type fastening material as described in numerous prior patents, such as U.S. Pat. No. 4,995,617 issued on Feb. 26, 1991.

The description of the invention which follows, together with the accompanying drawings should not be construed as limiting the invention to the example shown and described, because those skilled in the art to which this invention appertains will be able to devise other forms thereof within the ambit of the appended claims.

DETAILED DESCRIPTION OF THE DRAWINGS

Figure 1:
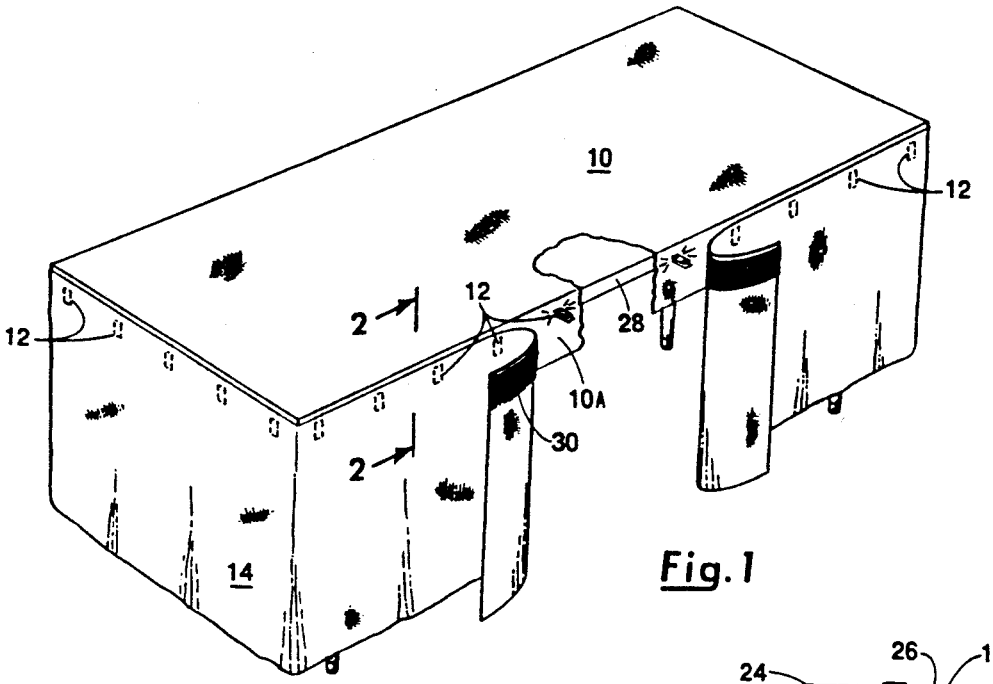
FIG. 1 is a perspective view illustrating the practice of the within skirt-attaching inventive method in relation to a banquet table.
Figure 3:
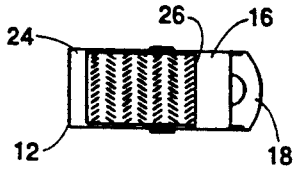
FIG. 3 is a plan view of the clip as seen in the direction of lines 3—3 of FIG. 2A.

To facilitate providing a finished appearance to a banquet tablecloth 10, use is made of a clip, generally designated 12, of a well understood construction and operating mode, but not heretofore used for this purpose. Underlying the within inventive use of the clip 12 is the recognition that the flexibility of the cloth construction material of the table covering 10 allows a pivotal traverse in the clip from an initial position of attachment to the tablecloth to a subsequent operative position of movement, in which latter position a decorative skirt is readily attached thereto, to provide the desired finished appearance to the tablecloth 10, all as will now be explained in detail.

Referring first to the structural details of the clip 12, it is of the well known type having two pivotally interconnected grips 16 and 18 having a spring 20 urging opposing object-engaging ends 22 and 24, optionally in the specific form of serrated teeth, into a normally closed position. In accordance with the present invention, a selected one grip 16 has adhesively secured to it a Velcro patch 26, of hook elements.

Figure 2A:
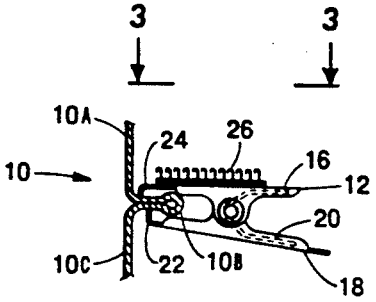
FIG. 2A is a view similar to FIG. 2, but illustrating an initial clip position preparatory to the operative position of FIG. 2.

In the practice of the within inventive skirt-attaching method, after tablecloth 10 is placed in covering relation over a banquet or similar table top 28, plural clips 12, as best shown in FIG. 1 are clipped at spaced-apart locations about the depending peripheral edge 10A of the tablecloth 10. This is readily achieved by merely pressing together the grips 16 and 18 against the urgency of the spring 20, positioning the then open gripping ends 22 and 24 against the prospective support surface or tablecloth edge 10A, and releasing the pressure on the grips 16 and 18. Spring 20 then urges the ends 22 and 24 in closing movement about a projected portion 10B of the edge 10A between the ends 22 and 24, and results in attachment of each clip to the cloth edge 10A, initially in the operative position illustrated in FIG. 2A. This initial position is one in which each attached clip 12 extends laterally of the table 28 with the Velcro patch 26 in a horizontally oriented plane.

Figure 2:
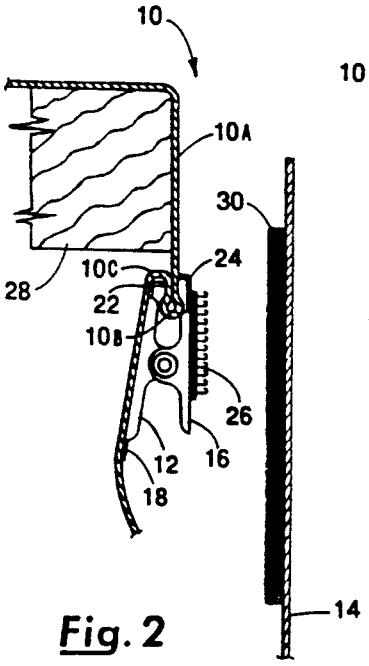
FIG. 2 is a side elevational view, on an enlarged scale, taken along lines 2—2 of FIG. 1 illustrating an operative position of a clip used in said skirt-attaching method.

Next, and as best illustrated in FIG. 2, each attached clip 12 is pivoted 90 degrees, as permitted by the fold 10C in the cloth edge 10A, into a vertically oriented plane, which correspondingly orients each Velcro patch 26 in an outwardly facing relation from the table 28.

The table skirt 14 is prepared with a cooperating hook element-embodied Velcro strip 30 stitched or adhesively secured along a top edge, which is moved into contact with, and thus attaches to, the clip Velcro patches 26, thereby completing the attachment of the decorative skirt 14 about the table 28.

Figure 4:
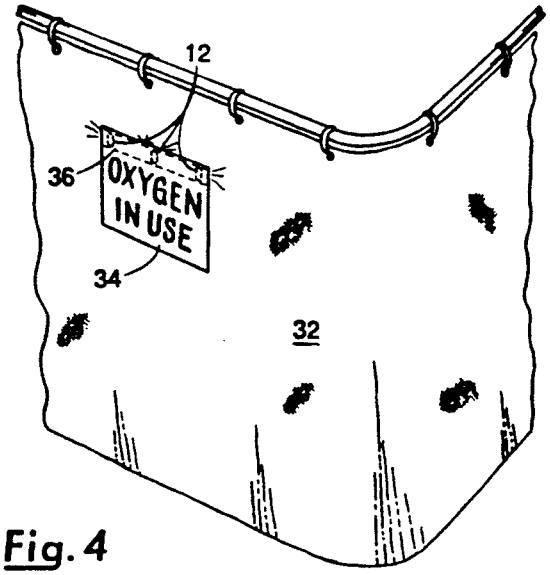
FIG. 4 is a perspective view illustrating another use of the within inventive clip.

Although the skirt-attaching method, as just described, is the primary contemplated use of the Velcro-embodied spring clip 12, it should be understood that the clip can also be used to attach objects other than a skirt, to any fabric vertical support. For example, as shown in FIG. 4, from the description already provided, it should be readily understood how clips 12 can be attached to a privacy hospital curtain 32, and turned 90 degrees to position the Velcro patches thereon to receive an object to be supported on the curtain, which object in the illustrated example of FIG. 4 is a typical hospital sign 34 having a Velcro strip 36 to cooperate with the clip Velcro patches.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A method of attaching a skirt for decorating a table in depending relation about the peripheral edge of a tablecloth in covering relation over said table using a clip of the type having pivotally interengaged grips, and a spring urging opposing object-engaging ends of said grips into a normally closed position and having a Velcro patch adhesively secured to one said grip, said method comprising the steps of clipping plural said clips in spaced relation to said tablecloth peripheral edge so that each clip initially extends in lateral relation therefrom with said Velcro patch thereon in a horizontally oriented plane, pivoting each said clip through an angular traverse so as to position each said Velcro patch thereon in a vertically oriented plane and in an outwardly facing relation from said table, and attaching to said clips, Velcro patches and a cooperating Velcro strip on said skirt, to thereby correspondingly attach said skirt to said tablecloth in suspended relation about said table.

* * * * *